US008286824B2

(12) United States Patent
Ikeda et al.

(10) Patent No.: US 8,286,824 B2
(45) Date of Patent: Oct. 16, 2012

(54) HEAT INSULATED CONTAINER

(75) Inventors: Shigeki Ikeda, Tokyo (JP); Yuji Nagase, Tokyo (JP)

(73) Assignee: Tokan Kogyo Co., Ltd., Tokyo (JP)

( * ) Notice: Subject to any disclaimer, the term of this patent is extended or adjusted under 35 U.S.C. 154(b) by 237 days.

(21) Appl. No.: 12/681,079

(22) PCT Filed: Oct. 16, 2008

(86) PCT No.: PCT/JP2008/002942

§ 371 (c)(1), (2), (4) Date: Apr. 7, 2010

(87) PCT Pub. No.: WO2009/054110

PCT Pub. Date: Apr. 30, 2009

(65) Prior Publication Data

US 2010/0224637 A1 Sep. 9, 2010

(30) Foreign Application Priority Data

Oct. 22, 2007 (JP) ..... 2007-274462

(51) Int. Cl.
*B65D 3/28* (2006.01)

(52) U.S. Cl. ..... 220/739

(58) Field of Classification Search ..... 220/62.22, 220/62.12, 592.2, 592.26, 737, 738, 739; 229/402, 403

See application file for complete search history.

(56) References Cited

U.S. PATENT DOCUMENTS 5,469,983 A 11/1995 Yawata
5,667,135 A 9/1997 Schaefer
5,769,311 A * 6/1998 Morita et al. ..... 229/403
5,794,843 A 8/1998 Sanchez
6,308,846 B1 10/2001 Muller
6,364,149 B1 4/2002 Smith
6,739,470 B2 * 5/2004 Yawata ..... 220/62.12
7,464,856 B2 * 12/2008 Van Handel ..... 229/403
2002/0158074 A1 10/2002 Yawata (Continued)

FOREIGN PATENT DOCUMENTS

JP 7-40961 A 2/1995

(Continued)

OTHER PUBLICATIONS

Search Report issued Aug. 8, 2011 in corresponding European Patent Application No. 08842789.3 (national phase of PCT/JP2008/002942).

(Continued)

*Primary Examiner* — David Fidei

(74) *Attorney, Agent, or Firm* — Westerman, Hattori, Daniels & Adrian, LLP

(57) ABSTRACT

An insulating container includes a container main body and an exterior sleeve to be fit onto the container main body. The exterior sleeve includes a slit forming section including a group of slits formed on the exterior sleeve. An inside wall surface of the exterior sleeve is provided with a shrink-deformable film, an upper portion of the shrink-deformable film is bonded to an upper portion of the exterior sleeve beyond the slit forming section, whereas a middle section covering the slit forming section is free from bonding, a lower portion is bonded to a lower portion of the exterior sleeve beyond the slit forming section, and the shrink-deformable film is shrunk to have the slit forming section project outwardly from the exterior sleeve.

10 Claims, 9 Drawing Sheets

U.S. PATENT DOCUMENTS

| | | | | |
|---|---|---|---|---|
| 2007/0215618 | A1* | 9/2007 | Wright et al. | 220/62.12 |
| 2007/0262129 | A1* | 11/2007 | Zadravetz | 229/403 |
| 2009/0114661 | A1* | 5/2009 | Lim | 220/737 |

FOREIGN PATENT DOCUMENTS

| | | | |
|---|---|---|---|
| JP | 2001-55278 | A | 2/2001 |
| JP | 2004-9670 | A | 1/2004 |
| JP | 2006-44723 | A | 2/2006 |
| JP | 2006-160346 | A | 6/2006 |
| JP | 2006-248539 | A | 9/2006 |
| JP | 2007-137468 | A | 6/2007 |
| JP | 2007-204106 | A | 8/2007 |
| RU | 2208566 | C2 | 7/2003 |
| WO | 2006/095730 | A1 | 9/2006 |

OTHER PUBLICATIONS

Decision to Grant a Patent dated May 19, 2010, issued in corresponding Japanese Patent Application No. 2009-537927.

Decision to Grant a Patent dated Feb. 10, 2011, issued in corresponding Russian Patent Application No. 2010120711.

International Search Report of PCT/JP2008/002942, mailing date of Dec. 9, 2008.

* cited by examiner (a)

(b)

HEAT INSULATED CONTAINER

TECHNICAL FIELD

The present invention relates to an insulating container including a shrink-deformable film, in which a flat body portion of the container being partially projected outwardly to deform it into an insulating holder.

BACKGROUND ART

The present applicant proposes in Patent Literature 1 and Patent Literature 2 such a configuration of an insulating container that an exterior sleeve is slidably fit onto an outer circumferential surface of a body portion of a container main body and one end of the exterior sleeve is bonded onto the outer circumferential surface of the body portion as well as the exterior sleeve is compressed in an up-and-down direction to have a plurality of slit forming sections provided on the exterior sleeve project outwardly from the exterior sleeve to form an insulating holder, the insulating container characterized in that the exterior sleeve is pulled-up and pulled-down with a help of a human power to deform the slit forming sections into the insulating holder. The insulating container disclosed in the above described publications has produced a reasonable effect.

On the other hand, Patent Literature 3 discloses a heat-insulating developing tacky adhesive label with a heat-shrinkable film. However, the label has such a configuration that a deformation caused by heat-shrinkage is controlled by a cut line having a transverse H-shape and therefore the configuration has a drawback that it is only applicable to labels.

It is an object of the present invention, as a result of a continued study, to provide an insulating container in which a slit forming section is deformed into an insulating holder by using a heat-shrinkable film which is directly heated or a shrinkable film which is indirectly heated by microwave.

Patent Literature 1: Japanese Patent Laid-open Publication No. 2006-44723

Patent Literature 2: Japanese Patent Laid-open Publication No. 2006-160346

Patent Literature 3: Japanese Patent Laid-open Publication No. 2007-137468

DISCLOSURE OF THE INVENTION

Problems to be Solved by the Invention

The present invention was made in view of the above described recent circumstances, and therefore, a main subject of the invention is to provide a container using a heat-shrinkable film, a film which is shrink-deformed by heat generated by microwave, or a shrink-deformable film made of a shape-memory resin which deforms into a shrunk shape by heat, wherein an exterior sleeve is heated or is subjected to microwave, as required, in order to have the exterior sleeve project outwardly by compressing a slit forming section provided on the exterior sleeve in an up-and-down direction.

Means for Solving the Problem

The present invention is mainly characterized in that the shrink-deformable film is bonded to an upper portion and a lower portion, respectively, beyond the slit forming section provided on the external sleeve to thereby ease to compress-deform the slit forming section into an insulating holder by shrinking the exterior sleeve.

Effects of the Invention

In the present invention, the container is made into a shape having a low stack height and being free from blocking, while the container is formed or shipped. For example, the container can be deformed into an insulating holder by having the slit forming section of the exterior sleeve project outwardly in such a manner that hot water or high-temperature drink is poured into the container, the container is heated, or the container is subjected to microwave by a kitchen microwave, for example, when the container is used as a table ware or a drink container. Further, in the present invention, an improved heat releasing effect can be produced because of a space formed between the exterior sleeve and a container main body, such that it is no more necessary to move the exterior sleeve by hands.

The above described shrink-deformation of the exterior sleeve can be achieved not only at the time of using the container but at any time it is necessary if the exterior sleeve is heated or subjected to microwave, for example, at the time of packaging the container.

Further, the exterior sleeve is provided with the slit forming section, which eliminates a necessity to form an air space between the slit forming section and the container main body before deformation. Therefore, the container can be made into a stack height identical to that of the general containers, resulting in eliminating the blocking problem.

Still further, since the stack height of the container becomes lower and constant, an improved transport effect can be produced, a mechanical adaptability improves when separating the containers, and a handling ability of the container improves.

A shape of the insulating holder can be changed according to shapes of the slits of the slit forming section.

Further, when the exterior sleeve is formed into a cylindrical shape, the slit forming section includes the outside bonding portion and notches formed on the inside bonding portion in a corresponding manner, and a portion of the shrink-deformable film corresponding to the outside bonding portion is directly heated through the container main body, and thereby the slit forming section formed on the outside bonding portion also can securely be projected downwardly.

Further, if a display portion is provided on a wall surface of a body portion of a container main body at a portion exposed when the exterior sleeve is shrunk, a customer can enjoy the display portion.

BRIEF DESCRIPTION OF THE DRAWINGS

FIG. 12(*b*) is a cross sectional view of a portion of the cup-shaped container to which the exterior sleeve is bonded.

FIG. 13(*b*) is a cross sectional view of a portion of the cup-shaped container to which the exterior sleeve is bonded.

EXPLANATIONS OF LETTERS OR NUMERALS

Figure 1:
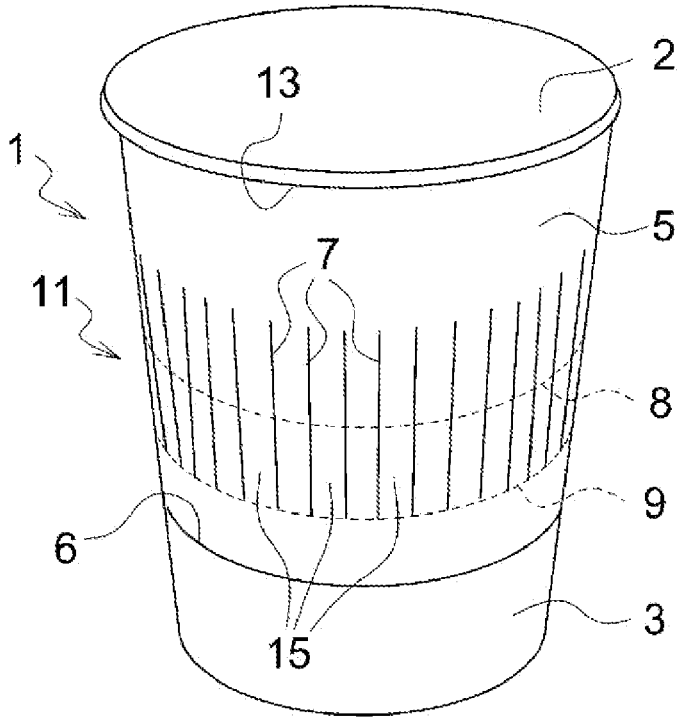
FIG. 1 is a perspective view illustrating a cup-shaped container according to a first exemplary embodiment before it is deformed.
Figure 2:
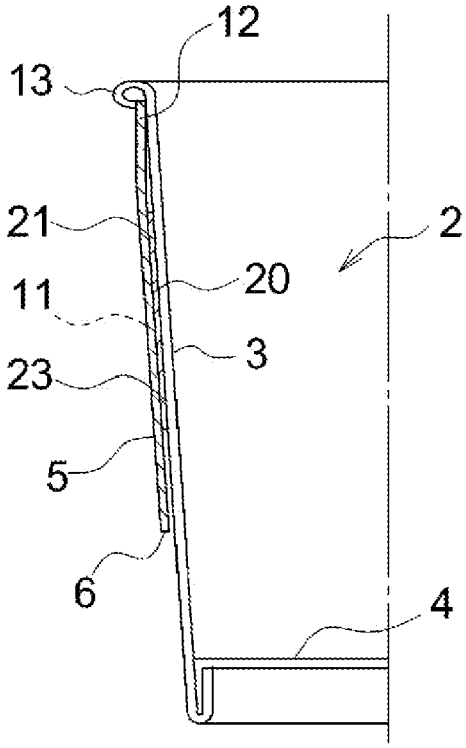
FIG. 2 is a partially cross sectional view of a cup-shaped container of FIG. 1.

1 cup-shaped container
2 container main body
3 body portion wall
4 bottom portion wall
5 exterior sleeve
7 slit
8 ruled line for mountain fold
8*a*, 8*b* ruled line for mountain fold
9, ruled line for valley fold
9*a*, 9*b* ruled line for valley fold
10*a* outside bonding portion
10*b* inside bonding portion
10*c* notch
11 slit forming section
12 upper end portion
13 curled portion
15 strip of paper
15*a*, 15*b* strip of paper including ruled lines at different positions
16 insulating holder
16*a*, 16*b* insulating holder including ruled lines at different positions
17 upper portion
18 lower portion
19*a* ruled line for bonding
20 shrink-deformable film
21 upper portion
21' upper overlap width portion
22 middle section
23 lower portion
23' lower overlap width portion

BEST MODE(S) FOR CARRYING OUT THE INVENTION

In order to automatically cause a deformation to provide projecting portions on a flat exterior sleeve for the sake of heat insulation, a shrinkable film provided along an inner wall surface of the exterior sleeve is bonded to a predetermined position to cause the automatic deformation.

First Exemplary Embodiment

[Cup-shaped Container]

A cup-shaped container 1 as illustrated in FIGS. 1 through 4 comprises a cup-shaped container main body 2 including a body portion wall 3 having a water-resistance interior surface and a bottom portion wall 4, and an exterior sleeve 5.

The exterior sleeve 5 includes a slit forming section 11 having a group of a plurality of slits provided over a predetermined area in a height direction of the container, and being fit onto an outer circumferential portion of the body portion wall 3 so as to cover the body portion wall.

In the present exemplary embodiment, examples of the cup-shaped container 1 include a cup-shaped container formed of only a paper material, a cup-shaped container formed of a paper material laminated with a synthetic resin film, a cup-shaped container formed of a paper material impregnated with a synthetic resin, a cup-shaped container formed of a paper material laminated with a synthetic resin film or a metallic foil, and a cup-shaped container made of a synthetic resin or the like, regardless of a presence or an absence of a cap.

In the present invention, the container may not be limited to a cup shape but may have any shape.

[Exterior Sleeve]

The exterior sleeve 5 is a sheet material made of a paper or made basically of a paper, e.g., a synthetic laminated paper or the like. The exterior sleeve 5 is formed into a slightly tapered cylindrical body in parallel with the body portion wall 3 of the container main body 2 leaving a narrow space therebetween so as to be in conformity with a shape of the body portion wall 3 of the container main body 2 such that the exterior sleeve 5 fits onto the outer circumferential surface of the body portion wall 3 of the container main body 2. Accordingly, the exterior sleeve 5 is fit onto the container main body 2.

In the case of an example illustrated in the drawings, an upper portion of the exterior sleeve 5 extends to a position adjacent to a curled portion 13 of an upper portion of an opening of the container main body 2 and an upper end portion 12 thereof is fixed to the container main body 2, and a lower portion of the exterior sleeve 5 extends to a position of a halfway of the container main body 2 or a position slightly below a halfway of the container main body 2.

Any means such as a bonding, a fastener means, or the other fastener means using a friction force or the like may be used as the fixing means (not shown).

Here, a slit 7 may not be limited to a straight shape but may have a curved shape or a wave shape.

[Slit Forming Section]

The slits 7 are formed on an entire circumference of an approximate middle section of the exterior sleeve 5 such that the slits having the same length extend in an up-and-down direction at about equally spaced. In this manner, the slit forming section 11 including a plurality of strips of paper 15 cut between the slits 7, 7 is formed on the exterior sleeve 5.

Each of the strips of paper 15 is provided with a ruled line as a starting point of a folding line when it is deformed in a projecting manner. It is preferable that the strip of paper 15 includes a ruled line for valley fold which is connected to an upper end and/or a lower end of at least one of the slits of the strip of paper 15 and is crossing transversely over the strip of paper 15, and one or a plurality of ruled lines which crosses each of the strips of paper 15 at a halfway position thereof.

In the present exemplary embodiment, as illustrated by a broken line in FIG. 1, a ruled line for mountain fold 8 and a ruled line for valley fold 9 are formed at about a center portion and a lower portion of the strips of paper 15 throughout the entire circumference in a circumferential direction.

The ruled lines 8, 9 run only on a portion of paper of the exterior sleeve 5, except for a shrink-deformable film 20 of the exterior sleeve 5, so as to half cut only the portion of paper by a dotted line in the present exemplary embodiment. However, the other publicly known ruled line for mountain fold and ruled line for valley fold may be applicable to the present exemplary embodiment.

The exterior sleeve 5 formed in a manner as described above can slide with respect to the container main body 2 between a lower portion 6 of the exterior sleeve 5 and an upper portion of the slit forming section 11 provided with strips of paper 15.

[Shrink-Deformable Film]

The shrink-deformable film 20 is attached to an inner wall surface of the exterior sleeve 5.

An upper portion 21 of the shrink-deformable film 20 is bonded to an upper portion of the slit forming section 11 in a state of tension, a lower portion 23 of the shrink-deformable film 20 is bonded to a lower portion of the slit forming section 11, and a middle section 22 of the shrink-deformable film 20 is free from bonding to the slit forming section 11.

Figure 5:
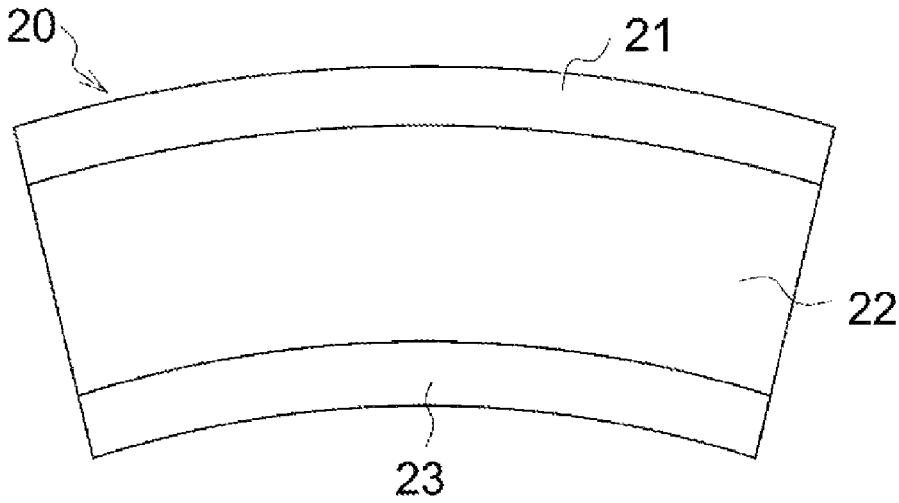
FIG. 5 is a front view illustrating an exploded state of a shrink-deformable film.

The shrink-deformable film 20 includes overlap width portions along the upper portion 21 and the lower portion 23 as shown in FIG. 5, and is bonded to the adjacent portions of the upper portion and the lower portion of the slit forming section 11 so as to cover the slit forming section 11 of the exterior sleeve 5.

Each of the above described overlap width portions can be made such that an adhesive is transferred to an edge portion of the upper portion and an edge portion of the lower portion of the shrink-deformable film 20, respectively. However, if a double-faced tacky tape is used, the overlap width portion made of an adhesive material layer can be readily formed on each of the edge portion of the upper portion and the edge portion of the lower portion, respectively, without heating the shrink-deformable film 20.

Figure 6:
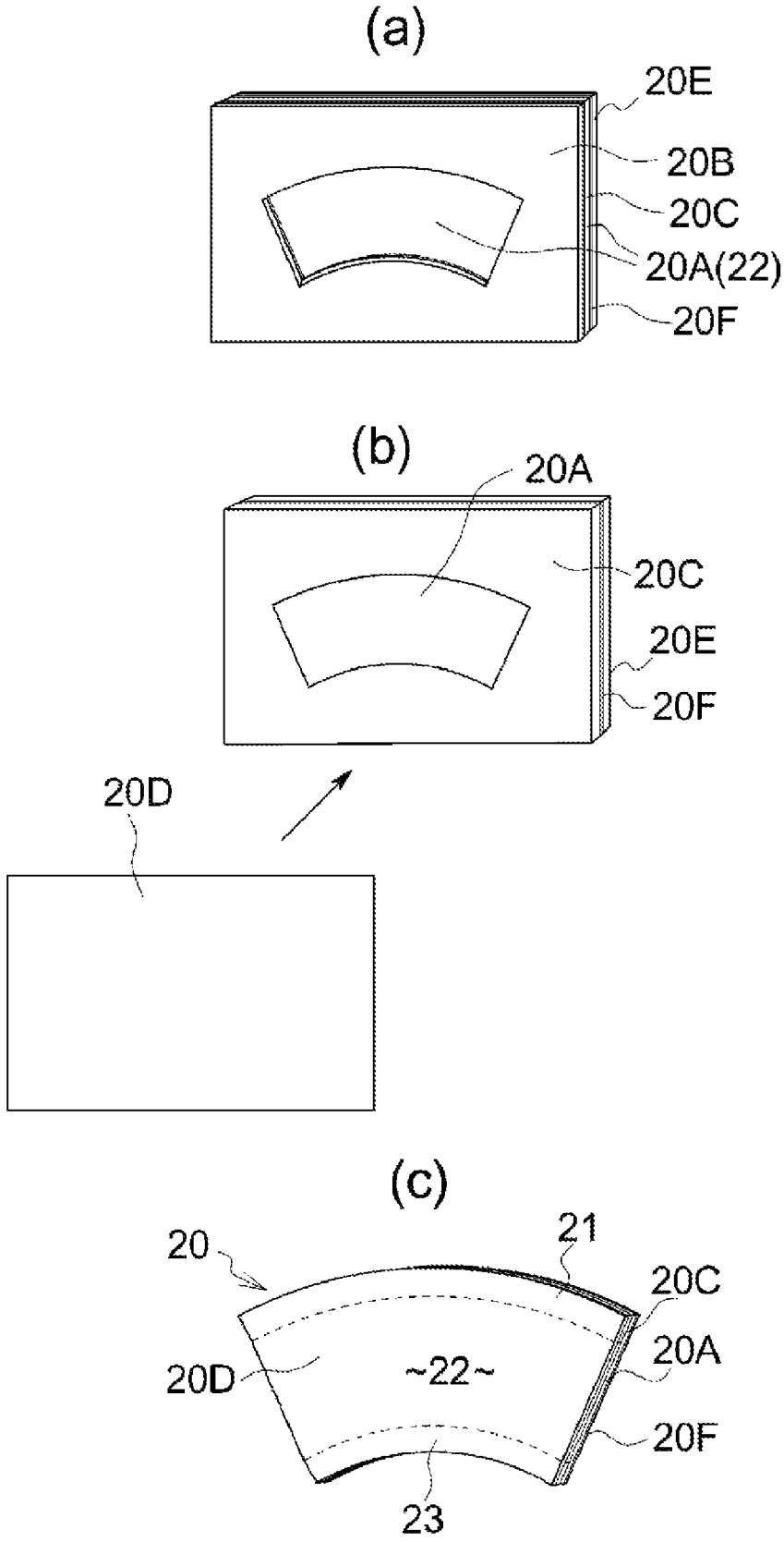
FIG. 6 is an explanatory view illustrating a forming process of the shrink-deformable film, in which FIG. 6(*a*) is a view one side of an exemplary double-faced adhesive tape being half-cut, FIG. 6(*b*) is a view illustrating a state a release paper of one side of the shrink-deformable film is released and, instead, an another film is bonded thereto, and FIG. 6(*c*) is a view illustrating a state the shrink-deformable film is cut into a predetermined shape.

First of all, as illustrated in FIG. 6(*a*), one side of the double-faced tacky tape, of which base material is a PET resin film, is half-cut into a shape of the middle section 22 to have the PET resin film 20A free from the adhesive surface be exposed.

Subsequently, as illustrated in FIG. 6(*b*), a remaining release paper 20B on the one side is released and a PET resin film 20D of a separate body is bonded to an adhesive surface 20C of the one side.

Accordingly, a non-bonded state is given to the middle section 22, i.e., the middle section 22 is free from bonding between the PET resin film 20A as the base material and the PET resin firm 20D as the separate body, while an upper end portion and a lower end portion are bonded to each other.

Then, the shrink-deformable film is cut in conformity with a shape of an outer circumferential shape of the exterior sleeve 5. A release paper 20E of the other side is released and an adhesive surface 20F thus exposed is bonded to the body portion wall 3 (see FIG. 7(*a*)).

Accordingly, the shrink-deformable film 20 can be attached to the exterior sleeve 5 with ease.

The above description is an example of configuration in which the shrink-deformable film 20 is attached onto the exterior sleeve 5, and thus the present invention is not limited to the example.

Preferably, the heat-shrinkable film 20 is made of a material having a shrinkage force which provides the slit forming section 11 of the exterior sleeve 5 with an outward flexure or curvature when the heat-shrinkable film is deformed as well as having a strength capable of keeping the shrunk shape after the heat-shrinkable film 20 is deformed. The PET resin film of 70% shrinkage ratio was used in the present exemplary embodiment.

Here, it is preferable that a uniaxially-stretched film is used as the PET resin film. However, in the present invention, the above described types of films and shrinkage ratio are described only for the sake of the examples and thus are not limitative.

Further, the shrunk shape of the heat-shrinkable film 20 after it is shrunk can be kept not only according to the strength of the heat-shrinkable film 20 but also according to a friction force caused between the exterior sleeve 5 and the body portion wall 3 of the container main body 2.

Then, when the heat-shrinkable film 20 is heated, the slit forming section 11 is compressed in an up-and-down direction to thereby have the insulating holder 16 project outwardly from the exterior sleeve 5.

For more specific example, when the heat-shrinkable film 20 is heated through the exterior sleeve 5, the heat-shrinkable film 20 shrinks. However, at the time, since the upper portion 21 and the lower portion 23 of the heat-shrinkable film 20 are fixed to the body portion wall 3, only the middle section 22 shrinks to compress the slit forming section 11 in the up-and-down direction.

In the present exemplary embodiment, since the upper portion of the exterior sleeve 5 is fixed to the body portion wall 3 of the container main body 2, the lower portion of the slit forming section 11 is pressed upwardly, and thus the strip of paper 15 between the adjacent slits 7, 7 is guided by the ruled line 8 and the ruled line 9 to have the strip of paper bend outwardly in a general dog-leg shape. Accordingly, an insulating space is formed between the exterior sleeve 5 and the body portion wall 3, resulting in forming the insulating holder 16.

In the present exemplary embodiment, a case where the upper portion of the exterior sleeve 5 is fixed to the body portion wall 3 of the container main body 2 is exemplified. However, the lower portion of the exterior sleeve 5 may be fixed to the body portion wall 3 of the container main body 2 instead.

At the time, the upper portion of the slit forming section 11 is pressed downwardly and thus the strip of paper 15 between the adjacent slits 7, 7 is guided by the ruled line 8 and the ruled line 9 to have the strip of paper bend outwardly in a general dog-leg shape. Accordingly an insulating holder 16 is formed (not shown).

Further, when the shrink-deformable film 20 is heat-deformed, a heat-shrinkage temperature of the shrinkable film for packaging the cup-shaped container 1 should be set to a temperature lower than the heat-shrinkage temperature of the shrink-deformable film 20, thereby allowing the cup-shaped container to be packaged keeping a shape of the cup-shaped container 1 as it is before the shrinkable film for packaging the cup-shaped container 1 is deformed. Then, the insulating holder 16 can be formed by being heated when the cup-shaped container 1 is used.

A time when the insulating holder 16 is formed is not limited to a time when the container is used, but can be at any time.

For example, if the heat-shrinkage temperature of the shrinkable film is set to a temperature greater than the heat-shrinkage temperature of the heat-shrinkable film 20, the insulating holder 16 can be formed at the same time when the cup-shaped container 1 is packaged.

Second Exemplary Embodiment

Figure 8:
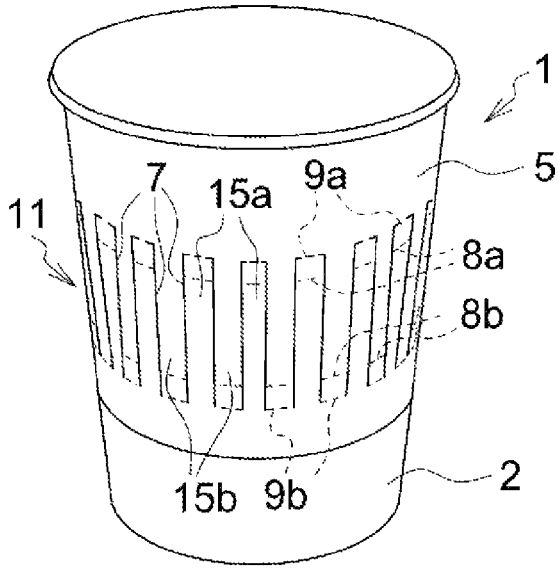
FIG. 8 is a perspective view illustrating an exemplary embodiment of the container provided with another shaped ruled lines connecting slits.

In the exterior sleeve 5, a shape of the ruled line formed on the strip of paper 15 is not limited to that as illustrated in the above described exemplary embodiment but, for example, as illustrated in FIG. 8, the ruled lines may be provided alternately for every adjacent strips of paper.

More specifically, a strip of paper 15*a* including a ruled line for valley fold 9*a* which is formed between upper portions of the slits 7 and a ruled line for mountain fold 8*a* which is formed lower than the ruled line for valley fold 9*a* spaced by a predetermined distance, and a strip of paper 15*b* including a ruled line for valley fold 9*b* which is formed between lower portions of the slits 7 and a ruled line for mountain fold 8*b* which is formed higher than the ruled line for valley fold 9*b* spaced by a predetermined distance are arranged alternately.

Meantime, the ruled line for mountain fold 8*a* of the strip of paper 15*a* and the ruled line for mountain fold 8*b* of the strip of paper 15*b* are spaced to each other by a predetermined distance in a height direction.

Figure 3:
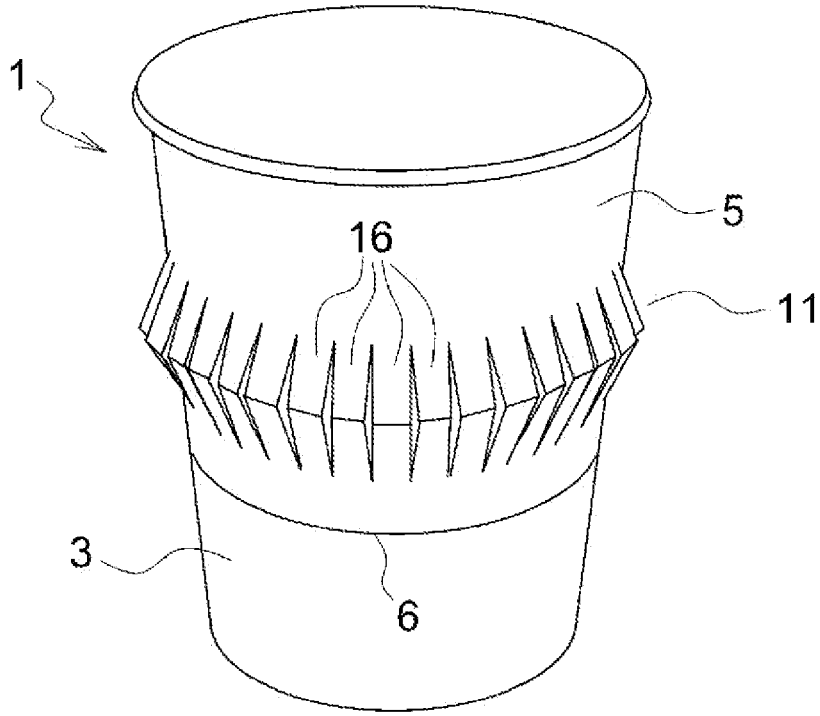
FIG. 3 is a perspective view of the cup-shaped container of FIG. 1 after it is deformed.
Figure 4:
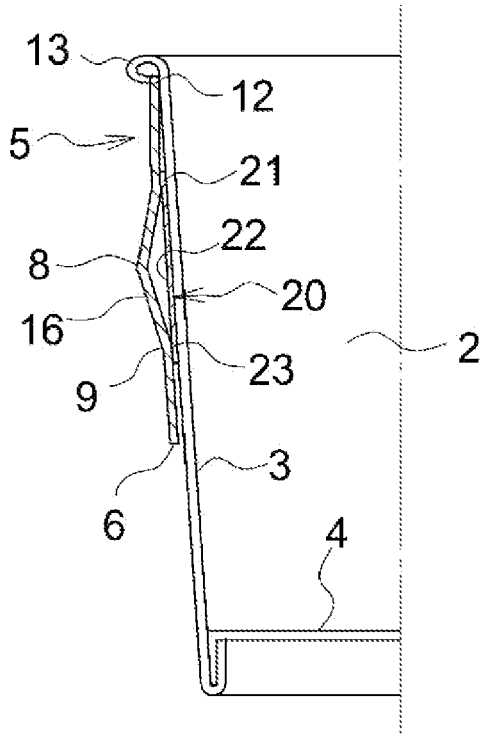
FIG. 4 is a partially cross sectional view of the cup-shaped container of FIG. 3.

Configurations of the above ruled lines are disclosed, for example, in FIGS. 3 and 4 of the Patent Literature 2.

Explanation of the configurations of the ruled lines other than the above are omitted here since they are identical to those of the first exemplary embodiment.

Third Exemplary Embodiment

Figure 7:
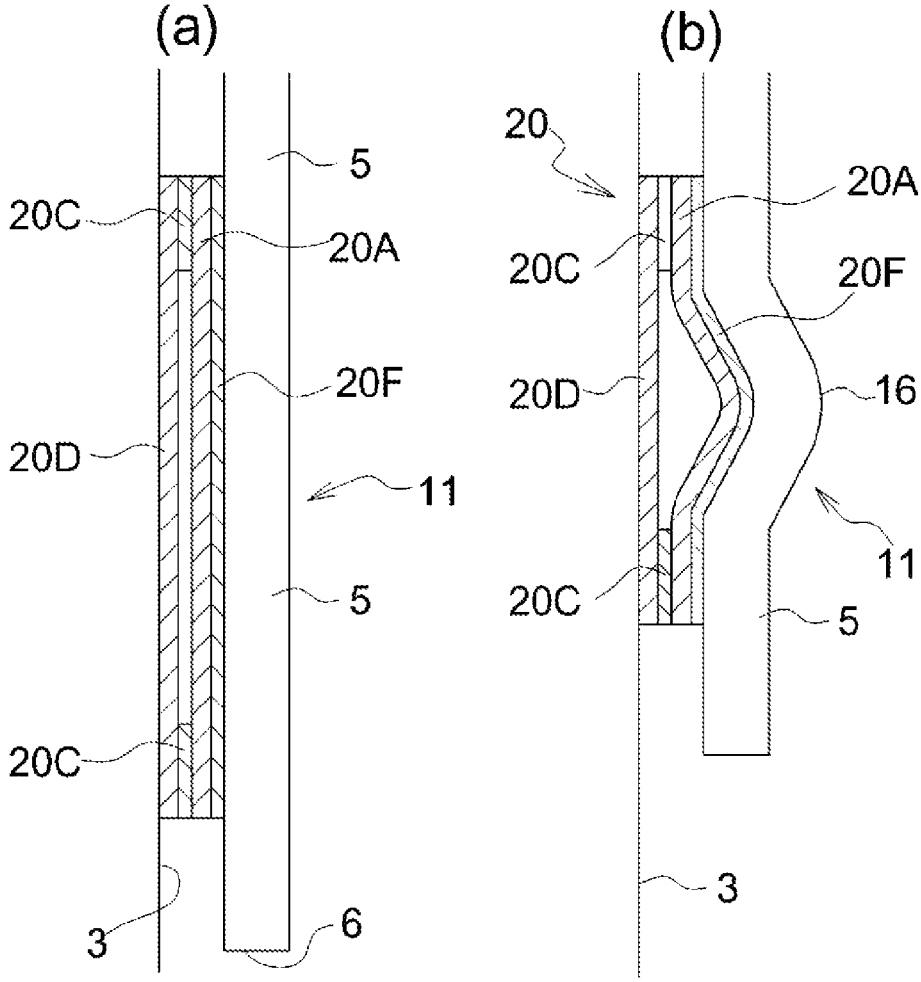
FIG. 7(*a*) is a cross sectional view illustrating a state the shrink-deformable film of FIG. 6 is bonded to an exterior sleeve before the shrink-deformable film is deformed, and FIG. 7(*b*) is a cross sectional view of the same after the shrink-deformable film is deformed.
Figure 9:
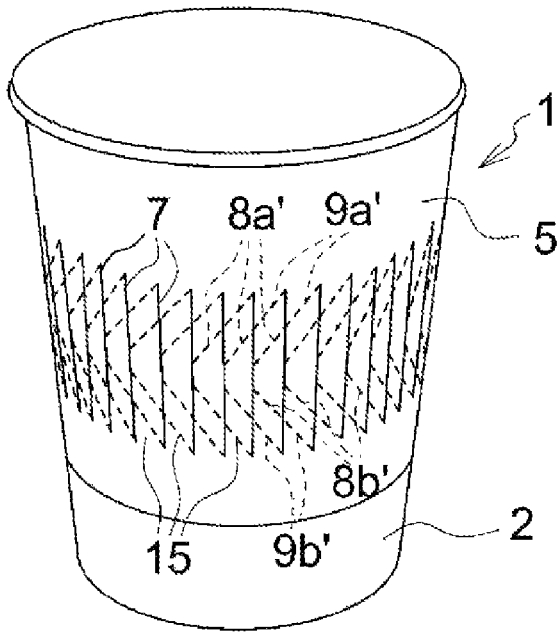
FIG. 9 is a perspective view illustrating another exemplary embodiment of the container provided with further another shaped ruled lines.

Four ruled lines are formed on every strips of paper 15 in FIG. 9 as they are disclosed in FIGS. 6 and 7 of the Patent Literature 1 and in FIGS. 6 and 7 of the Patent Literature 2.

More specifically, each strip of paper 15 of the cup-shaped container 1 of the present exemplary embodiment includes a first ruled line for valley fold 9*a*' with a predetermined angle (an angle of 45 degrees in the illustration) so as to form a declining line from an upper end of the slit 7, a second ruled line for mountain fold 8*a*' which is formed in parallel below the first ruled line for valley fold 9*a*', the first ruled line 9*a*' which declines with a predetermined angle (an angle of 45 degrees in the illustration), a third ruled line 9*b*' for valley fold with a predetermined angle (an angle of 45 degrees in the illustration) so as to form an inclining line from a lower end of the slit 7, and a fourth ruled line for mountain fold 8*b*' which is formed in parallel with the third ruled line 9*b*' spaced by a predetermined distance (almost the same distance between the first ruled line 9*a*' and the second ruled line 8*a*').

As described above, a paired upper and lower ruled lines 9*a*' and 8*a*', and a paired upper and lower ruled lines 8*b*' and 9*b*', namely a total four ruled lines, are provided on the strip of paper 15 at its upper portion and lower portion, respectively. Accordingly, a shape formed by the bended strips of paper constitutes a trapezoidal frustum-shaped air space between the slit forming section and the body portion wall of the container main body.

Explanations of the configurations other than the above are omitted here since they are identical to those of the first exemplary embodiment.

In the present invention, the strips of paper and the ruled lines are not limited to specific shapes, but are sufficient if they can project outwardly.

Fourth Exemplary Embodiment

Figure 10:
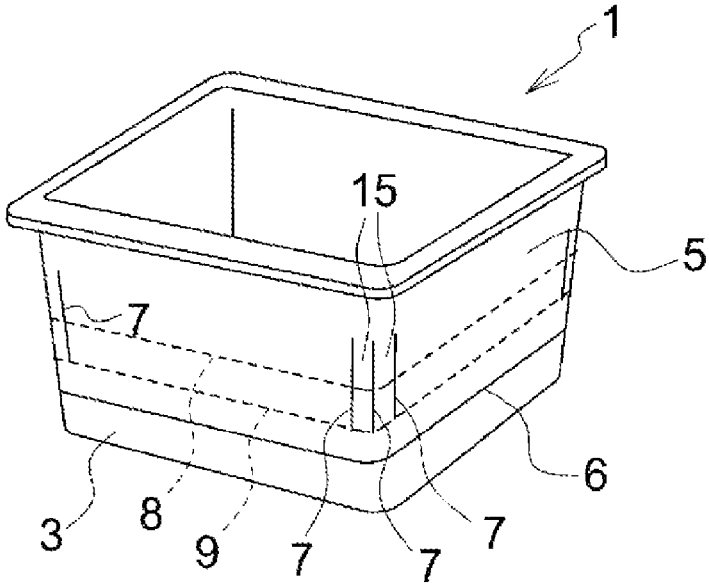
FIG. 10 is a perspective view illustrating another exemplary embodiment of the container, having a box-like shape, partially provided with slits.

The slits 7 for forming the strips of paper 15 may be formed throughout the entire circumference of the exterior sleeve 5 at predetermined intervals. Alternatively, the slits 7 may be formed at only desired portions (at corners in the illustration), as it is illustrated in FIG. 10.

More specifically, in the present exemplary embodiment, the slits 7 are formed only at four corners without forming them on flat surfaces.

Three slits 7 are formed on each of the corners as illustrated, and the ruled line for valley fold 9 running through at the lower end of the slits 7 and a ruled line for mountain fold 8 running through at about the middle of the slits 7 are provided throughout the entire circumference of the container.

A configuration of the above described strip of paper 15 is identical to the configuration of the strip of paper as disclosed in FIGS. 8 and 9 of the Patent Literature 2.

Explanations of the configurations other than the above are omitted here since they are identical to those of the first exemplary embodiment.

Further, in each of the above exemplary embodiments, the heat-shrinkable film is used as the shrink-deformable film 20. However, instead of the heat-shrinkable film, such a film may also be used that the shrink-deformable film 20 is shrunk by being subjected to microwave of a kitchen microwave to have the slit forming section 11 compressed such that the slit forming section 11 projects outwardly, thereby forming the insulating holder 16.

For example, the film may be a susceptor film such as an aluminum evaporation film.

With the susceptor film, the film can be shrink-deformed with an absence of a direct heating but only with an irradiation of microwave, because an aluminum thin film generates heat by being subjected to microwave and thus the heat-shrinkable film is shrunk by thus generated heat.

A shape of the shrink-deformable film 20 and an attachment configuration of the shrink-deformable film 20 to the exterior sleeve 5 are identical to those of the above exemplary embodiments, such that explanations thereof are omitted here but only a reference is made to the illustrations of the above exemplary embodiments.

A film made of a shape-memory resin may be used as the shrink-deformable film 20.

In this case, if the film is heated at a predetermined temperature, the film in a stretched state can change its state into a preliminary set shrunk state. Therefore, the film can be used as the shrink-deformable film 20 of the present invention.

A shape of the shrink-deformable film 20 and an attachment configuration of the shrink-deformable film 20 to the exterior sleeve 5 are identical to those of the above exemplary embodiments, such that explanations thereof are omitted here but only a reference is made to the illustrations of the above exemplary embodiments.

In the cup-shaped container of the present exemplary embodiment, an insulating holder having a high insulating effectiveness can automatically be formed by having the shrink-deformable film shrunk by means of heating the container from the inside (for example, pouring hot water into the cup-shaped container), heating the container from the outside (for example, at the time a shrinkable film package is heated), or being subjected to microwave to the container. Further, additional effects in an unpredictable quality and a design can also be produced owing to a stereoscopic change caused in the body portion.

Although it is not illustrated, more stereoscopic effect can be produced by preliminary providing a print on the outer circumferential surface of the body portion wall 3 of the container main body 2, since the print on the outer surface of the body portion wall 3 of the container main body can be viewed through the shrunk exterior sleeve 5 after the exterior sleeve 5 is formed into the insulating holder 16.

Fifth Exemplary Embodiment

Figure 11:
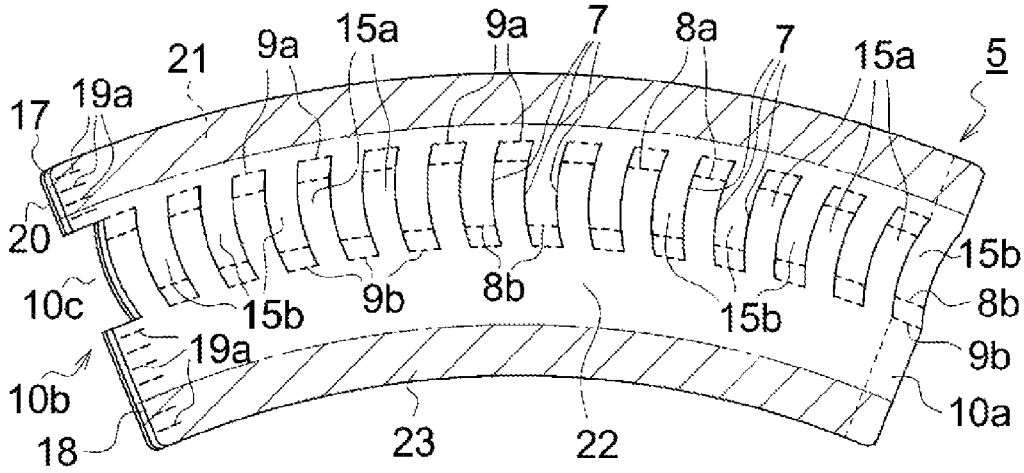
FIG. 11(*a*) is an exploded view when the exterior sleeve with the shrink-deformable film of a fifth exemplary embodiment is viewed from a front, and FIG. 11(*b*) is an exploded view when the same is viewed from a back.
Figure 11:
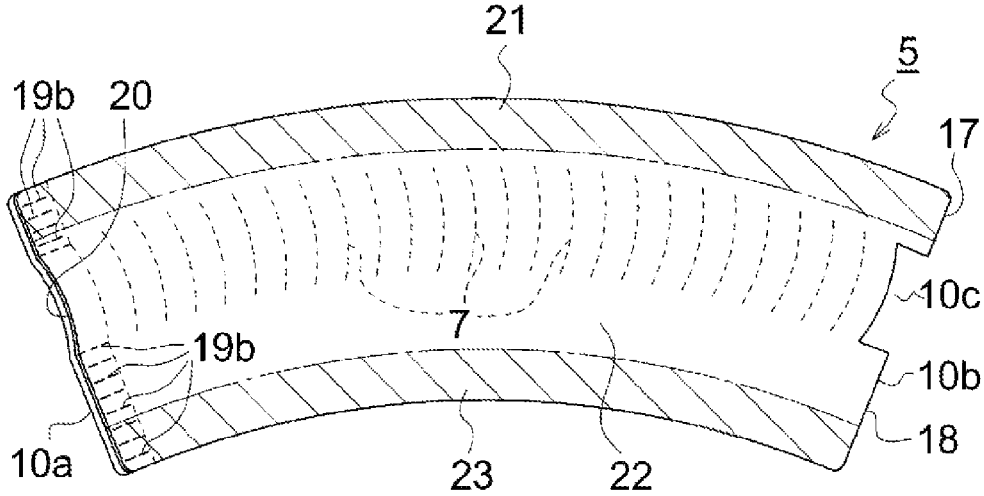
Figure 12A:
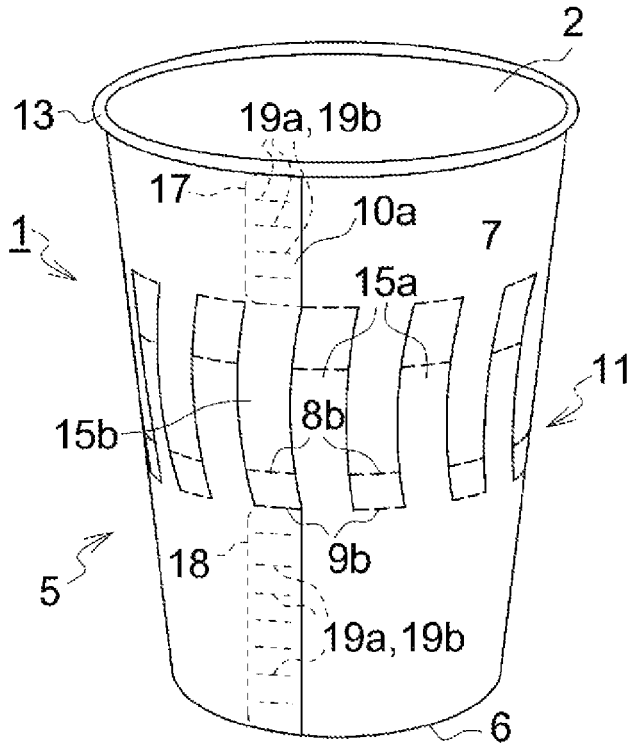
FIG. 12(*a*) is a perspective view of the cup-shaped container of the fifth exemplary embodiment before the shrink-deformable film is deformed.
Figure 12B:
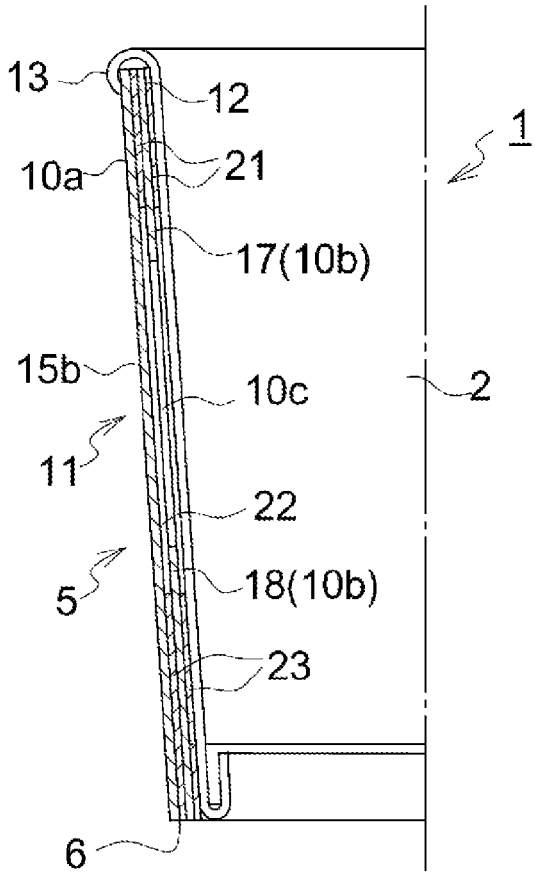
Figure 13A:
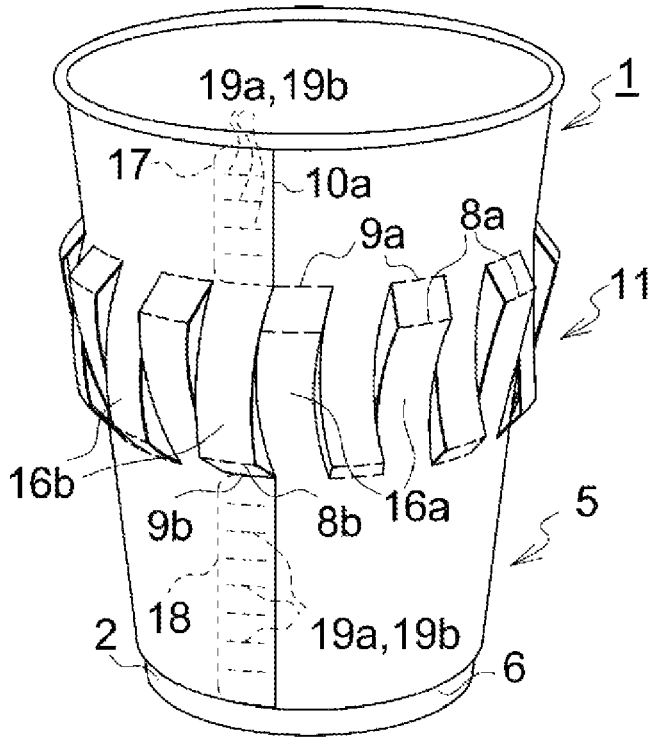
FIG. 13(*a*) is a perspective view of the cup-shaped container of the fifth exemplary embodiment after the shrink-deformable film is deformed.
Figure 13B:
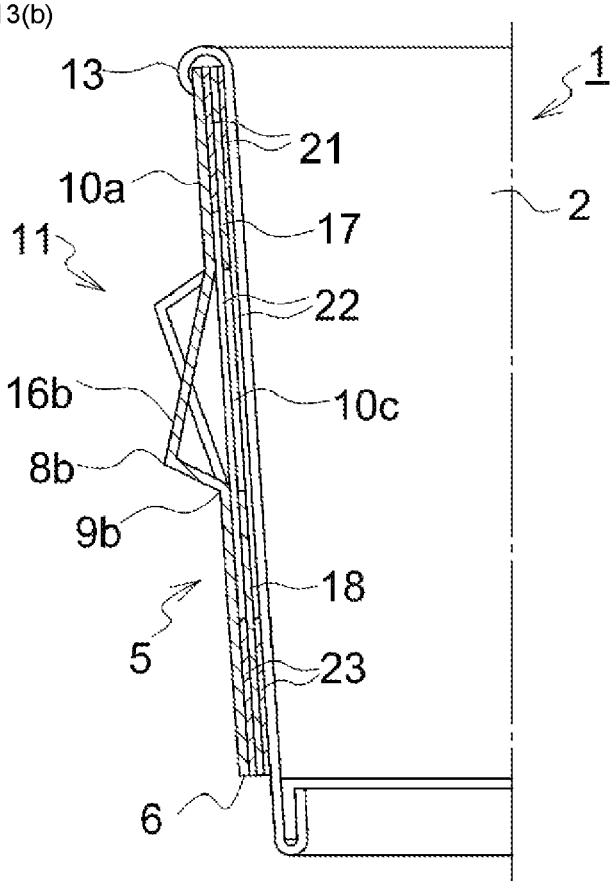

FIGS. 11 through 13 illustrate the exterior sleeves 5 having different shapes and the cup-shaped containers 1 with the same.

The exterior sleeve 5 includes arc-shaped slits 7 oriented in the same direction in a similar manner as the linear slits 7 as illustrated in FIG. 8.

Further, strips of paper 15*a*, 15*b* formed between the slits 7, 7 are arranged such that positions of the paired ruled lines for valley fold 9*a* and 8*a*, and the positions of the paired ruled lines for mountain fold 9*b* and 8*b* are alternatively inverted up and down in a similar manner as those of the exemplary embodiment of FIG. 8.

Further, in the fifth exemplary embodiment, an inside bonding portion 10*b* which gets under at the ends of the exterior sleeve 5 when the exterior sleeve 5 is wrapped over the container main body 2 and an outside bonding portion 10*a* which gets on at the ends of the exterior sleeve 5 when the exterior sleeve 5 is wrapped over the container main body 2 are set to a length within a range of a width of the strip of paper.

In the present exemplary embodiment, string of paper 15*a* has the same width as that of the strip of paper 15*b*. The inside bonding portion 10*b* and the outside bonding portion 10*a* have the same width as the width of the strips of paper 15*a* and 15*b*.

Further, the outside bonding portion 10*b* is provided with a notch 10*c* having a shape identical to the strip of paper 15*a* (or 15*b*).

Still further, an upper portion 17 and a lower portion 18 of the notch 10*c* of a surface of the outside bonding portion 10*b* are provided with a plurality of rows of ruled lines for bonding 19*a* of a half-cut shaped dotted-line.

Further, in the fifth exemplary embodiment, a rear surface of the exterior sleeve 5 is provided with the shrink-deformable film 20 having a shape identical to the exterior sleeve 5.

More specifically, the shrink-deformable film 20 is provided with an upper overlap width portion 21 at a side of the upper portion of the film and a lower overlap width portion 23 at a side of the lower portion of the film, respectively. The middle section 22 between the upper overlap width portion 21 and the lower overlap width portion 23 is free from bonding.

Then, the upper overlap width portion 21 is bonded onto the upper portion of the rear surface of the exterior sleeve 5 and the lower overlap width portion 23 is bonded onto the lower portion of the rear surface of the exterior sleeve 5, respectively. The middle section 22 is not bonded onto the rear surface of the exterior sleeve 5 although it covers over the slit forming section 11.

A bonding subsidiary portion 19*b*, which is formed to have a wide surface area by having grooves, slits, or concaved valley portions, is provided on the shrink-deformable film 20 bonded to the rear surface of an outside bonding portion 10*a* superimposed upon the inside bonding portion 10*b* at a position corresponding to the ruled line for bonding 19*a*.

The exterior sleeve 5 is wrapped around the entire circumstance of the body portion wall 3 of the cup-shaped container 1 and is formed into a cylindrical body, and an upper end 12 of the exterior sleeve 5 is inserted into a curled portion 13 to be fixed therein in a similar manner as it is done by the first exemplary embodiment.

Here, the exterior sleeve 5 of the fifth exemplary embodiment is formed into the cylindrical body such that the outside bonding portion 10*a* is superimposed onto the inside bonding portion 10*b*, and the shrink-deformable film 20 corresponding to the rear surface of the outside bonding portion 10*a* is bonded to the surface of the inside bonding portion 10*b*.

At the time, a portion of the shrink-deformable film 20 corresponding to the rear surface of the strip of paper 15*a* formed on the outside bonding portion 10*a* is in conformity with the notch 10*c* of the inside bonding portion 10*b* and thus does not contact the surface of the inside bonding portion 10*b*. Therefore, the portion of the shrink-deformable film 20 is kept free from bonding since it is not bonded onto the strip of paper 15*a* formed on the outside bonding portion 10*a* or the surface of the inside bonding portion 10*b*.

On the other hand, surfaces of the upper portion 17 and the lower portion 18 of the inside bonding portion 10*b*, which serve as bonding surfaces, contact the portion of the shrink-deformable film 20 corresponding to the rear surface of the outside bonding portion 10*a* and are bonded thereto through a heat bonding or the like. However, at the time, the bonding subsidiary portion 19*b* of the film 20 is superimposed onto the plurality of grooves of the ruled line for bonding and adhered thereto, thereby improving an adherence.

With the above described configuration, when the shrink-deformable film 20 is shrunk by being heated, a portion of the shrink-deformable film 20 corresponding to the slit forming section 11 of the external sleeve 5 having been formed into the cylindrical body is left in a state of being free from bonding throughout the entire circumference. Therefore, the portion of the shrink-deformable film 20 can be securely shrunk to be deformed into insulating holders 16*a*, 16*b* which are projecting into dog-leg shapes by having the strips of paper 15*a*, 15*b* be compressed in an up-and-down direction in a manner as illustrated in FIG. 13 from standby states having flat outer circumferences as it is illustrated in FIG. 12.

Configurations other than the above are identical to those of the preceding exemplary embodiments, such that explanations thereof are omitted here.

INDUSTRIAL APPLICABILITY

In the above exemplary embodiments, it is exemplified that the present invention is applicable to a cup-shaped container for the use of table wares, drink cups of automatic selling machines, or the like. However, the applicability of the present invention is not limited to any use of containers or any types of items to be stored.

Further, the applicability of the present invention is not limited to a cup-shaped container having a circular cross section, but the present invention is also applicable to containers having non-circular cross sections such as a container having a square cross section (see FIG. 10), a container having an oval cross section, and the like.

Still further, although the configuration of the container is exemplified as a double structure made of the container main body and the exterior sleeve, a triple structure may also be employable.

The invention claimed is:

1. An insulating container formed such that an exterior sleeve is slidably fit onto an outer circumferential surface of a body portion wall of a container main body, either one of an upper portion or a lower portion of the exterior sleeve is fixed onto the container main body, and a slit forming section including a group of slits is compressed in an up-and-down direction to have the slit forming section project outwardly from the exterior sleeve in order to form an insulating holder, a plurality of slits being formed within a certain range of the exterior sleeve in a height direction:

wherein a shrink-deformable film is attached to an inside wall surface of the exterior sleeve;

wherein an upper portion of the shrink-deformable film is bonded to an upper portion beyond the slit forming section of the external sleeve, a middle section covering the slit forming section is free from bonding, and a lower portion of the slit forming section is bonded to a lower portion beyond the slit forming section; and wherein the shrink-deformable film is shrunk to have the slit forming section project outward from the exterior sleeve, and wherein the lower end of the exterior sleeve is positioned equal to or upper than the bottom end of the container main body before deforming the slit forming section to project outward from the exterior sleeve.

2. The insulating container according to claim 1, wherein the shrink-deformable film is made of a heat-shrinkable film; and wherein the shrink-deformable film is shrunk by the exterior sleeve being heated, thereby having the slit forming section project outwardly.

3. The insulating container according to claim 1, wherein the shrink-deformable film is made of a film which generates heat by being subjected to microwave and is heat-shrunk by the generated heat; and wherein the shrink-deformable film is shrunk by the exterior sleeve being subjected to microwave to thereby compress the slit forming section to have the slit forming section project outwardly.

4. The insulating container according to claim 1, wherein the shrink-deformable film is made of a shape-memory resin which shrinks by being heated; and wherein the shrink-deformable film is shrunk by the exterior sleeve being heated to thereby compress the slit forming section, thereby having the slit forming section project outwardly.

5. The insulating container according to claim 1, wherein the shrink-deformable film has a shrinkage force to flex or curve the slit forming section of the exterior sleeve when the shrink-deformable film is shrink-deformed and has strength to keep a deformed shape of the slit forming section after the shrink-deformable film is shrunk.

6. The insulating container according to any one of claims 1 to 5, wherein the slit forming section includes:

a plurality of strips of paper having the same length, extended in an up-and-down direction, and divided into a plurality of slits formed at equal intervals along an outer circumferential wall;

a ruled line for valley fold transversely connected to an upper end and/or a lower end of at least one slit of each of the strips of paper; and at least one ruled line for mountain fold crossing each of the strips of paper at around a halfway position thereof.

7. The insulating container according to claim 1, wherein the exterior sleeve is formed into a cylindrical body including an inside bonding portion and an outside bonding portion to be bonded to each other at both ends of the external sleeve in a longitudinal direction at the time of expanding the cylindrical body;

wherein the slit forming section includes the outside bonding portion;

wherein the inside bonding portion includes a notch corresponding to a portion of the slit forming section formed on the outside bonding portion; and wherein the inside bonding portion is bonded onto the outside bonding portion at a portion except for the notch.

8. The insulating container according to claim 7, wherein groove-shaped ruled lines for bonding are formed at the portion except for the notch in order to help the bonding of the shrink-deformable film.

9. The insulating container according to claim 8, wherein a portion of a rear surface of the outside bonding portion of the shrink-deformable film, which is superimposed on the inside bonding portion, is provided with a bonding subsidiary portion including grooves, slits, or valley portions.

10. The insulating container according to any one of claims 1 to 5, wherein a display portion is provided at a portion of a surface of the body portion wall of the container main body, the portion being exposed when the exterior sleeve is shrunk.

* * * * *